US005655899A

United States Patent [19]

Hura et al.

[11] Patent Number: 5,655,899

[45] Date of Patent: Aug. 12, 1997

[54] APPARATUS AND METHOD FOR $NO_x$ REDUCTION BY CONTROLLED MIXING OF FUEL RICH JETS IN FLUE GAS

[75] Inventors: Harjit S. Hura, Wexford; Bernard P. Breen, Pittsburgh; James C. McMichael, Monroeville, all of Pa.

[73] Assignee: Gas Research Institute, Chicago, Ill.

[21] Appl. No.: 417,916

[22] Filed: Apr. 6, 1995

[51] Int. Cl.[6] ..... F23C 5/00

[52] U.S. Cl. ..... 431/8; 431/284; 431/188; 431/174

[58] Field of Search ..... 431/174, 187, 431/188, 284, 285, 8, 9

[56] References Cited

U.S. PATENT DOCUMENTS

| | | | |
|---|---|---|---|
| 2,167,183 | 7/1939 | Naab et al. | 431/284 |
| 2,671,314 | 3/1954 | Lichty | 60/39.02 |
| 2,941,585 | 6/1960 | Loebel et al. | 431/285 |
| 4,033,725 | 7/1977 | Reed et al. | 23/277 |
| 4,095,929 | 6/1978 | McCartney | 431/284 |
| 4,249,470 | 2/1981 | Vatsky | 431/284 |
| 4,400,151 | 8/1983 | Vatsky | 431/184 |
| 4,425,159 | 1/1984 | Nixon | 75/29 |
| 4,597,342 | 7/1986 | Green et al. | 110/347 |
| 4,726,192 | 2/1988 | Willis et al. | 60/737 |
| 4,779,545 | 10/1988 | Breen et al. | 110/212 |
| 4,790,743 | 12/1988 | Leikert et al. | 431/8 |
| 4,910,957 | 3/1990 | Moreno et al. | 60/39.03 |
| 5,078,064 | 1/1992 | Breen et al. | 110/212 |
| 5,181,475 | 1/1993 | Breen et al. | 110/345 |

FOREIGN PATENT DOCUMENTS 0 280 568 8/1988 European Pat. Off. .

*Primary Examiner*—Carroll B. Dority

[57] ABSTRACT

A fuel injector has an inner pipe within an outer pipe. The distal end of the inner pipe is set back from the distal end of the outer pipe to create a flame stabilization and mixing zone. A combustible gas and air mixture injected through the outer pipe forms a flame shroud around a gas stream injected through the inner pipe. This injector provides increased flame penetration and improved $NO_x$ reduction particularly when used to inject a flame shrouded gas stream into regions of the furnace at which the flue gas is at a temperature not greater than 2400° F.

25 Claims, 3 Drawing Sheets

APPARATUS AND METHOD FOR $NO_X$ REDUCTION BY CONTROLLED MIXING OF FUEL RICH JETS IN FLUE GAS

BACKGROUND OF INVENTION

1. Field of the Invention

The present invention relates to an apparatus and method for in-furnace reduction of nitrogen oxide emissions in flue gas.

2. Description of the Prior Art

During combustion of fuels with fixed nitrogen such as coal, oxygen from the air may combine with the nitrogen to produce nitrogen oxides. At sufficiently high temperatures, oxygen reacts with atmospheric nitrogen to form nitrogen oxides. Production of nitrogen oxide is regarded as undesirable because it results in acid rain, smog and ozone formation. Furthermore, the presence of nitrogen oxide in a furnace flue gas causes the condensed gases to become corrosive and acidic. There are numerous government regulations which limit the amount of nitrogen oxide which may be emitted from a combustion furnace. Title I and IV of the Clean Air Act Amendment of 1990 place stringent limits on nitrogen oxide emissions from large power plants. Consequently, there is a need for apparatus and processes which reduce the nitrogen oxide emissions in furnace flue gas.

Numerous attempts have been made to develop apparatus and processes which reduce the nitrogen oxide emissions in a furnace flue gas. One such approach is a process known as in-furnace nitrogen oxide reduction, reburning, or fuel staging. In reburning, coal, oil, or gas is injected above the primary flame zone to form a fuel-rich zone. A reburn zone stoichiometry of 0.90 is considered optimum for $NO_x$ control. The flue gas temperature in this zone is typically in the range 2400°–2800° F. The reaction time is of an order of 0.5 to 1.0 seconds. In this zone, part of the nitrogen oxides are reduced to ammonia (NH3) and cyanide-like fragments (HCN, etc) and molecular nitrogen (N2). Subsequently, air is injected to complete combustion. The reduced NH3 and cyanide-like fragments are then oxidized to form N2 and nitrogen oxide (NO).

Several problems occur when this process is used. First, coal may be an inefficient reburn fuel because of its high fixed-nitrogen composition. The fixed nitrogen introduced at this location in the furnace will have less chance of being converted to N2 and therefore have a higher chance of ending up as nitrogen oxide and may, depending on the nitrogen oxide concentration of the flue gas, increase the emissions of nitrogen oxide.

Furthermore, the fuel must be injected with a sufficient volume of gas to ensure mixing. This gas can be air or recirculated flue gas. If air is used as this gas, there must be enough fuel to consume the oxygen both in the flue gas and the air, and to supply an excess of fuel so reducing conditions exist. This increases the amount of fuel which must be used as reburn fuel. The necessity of using carrier air or recirculated flue gas requires extensive duct work in the upper part of the furnace.

Additionally, the reburn fuel must be injected well above the primary combustion zone of the furnace so that it will not interfere with the reactions taking place therein. However, this fuel must be made to burn out completely without leaving a large amount of unburned carbon. To do this, the fuel must be injected in a very hot region of the furnace some distance from the furnace exit. In addition, rapid mixing of the reburn fuel with the NO containing flue gas is beneficial. The exit temperature of the furnace must be limited in order to preserve the heat exchangers surface. Therefore, a tall furnace is required to complete the second stage process.

Moreover, the fuel must be injected in such quantities as to make the upper furnace zone fuel-rich. This fuel is supplied in excess to the amount of air in the furnace and ultimately requires more air to be completely combusted. Thus, air must be injected above the reburn fuel injection. The temperature in the combustion completion zone is typically in the range of 2200°–2400° F. The air addition system is designed to complete burnout before entering the convective steam surfaces. This requires even more duct work and furnace volume. Consequently, the combustion completion air injection must also be designed for rapid air mixing with the flue gas.

Most coal furnaces which are now in operation are not designed to accommodate the above described methods. Major modifications such as the provision of extensive ductwork and addition of a second stage to the process are required to utilize the prior art method. Such retrofitting is expensive.

Consequently, there is a need for a combustion apparatus and process which will reduce nitrogen oxide emissions in flue gas and which can be readily used in existing furnaces. An improved reburn technology has been patented by Breen et al. in U.S. Pat. Nos. 4,779,545; 5,078,064 and 5,181,475. The new technology, called reducing eddy after burn (REAB), differs from the standard reburn described above in several respects. REAB uses less natural gas than standard reburn. The furnace is not made overall fuel-rich as it is in standard reburn. Natural gas is injected at lower temperatures, 2100°–2400° F., consistent with chemical kinetics. This temperature range is much lower than the temperatures used in standard reburn. Operating at lower temperatures enables potentially higher $NO_x$ reductions because the thermodynamic equilibrium $NO_x$ is less than 100 ppm at 1600° F.

Breen et al. inject natural gas as fuel eddies (as generated by a turbulent fuel jet, a vortex ring generator or diffusive devices) whereas standard reburn uses turbulent gas jets with or without flue gas recirculation. REAB does not use flue gas recirculation. $NO_x$ reduction in the REAB process occurs in locally fuel rich zones, such as fuel eddies and vortex rings, in contrast to a globally fuel rich zone used in standard reburn.

Slow or controlled mixing of natural gas with flue gas occurs in REAB, in contrast to rapid mixing in standard reburn. In the REAB process there is no need for completion air addition since the furnace is over all fuel lean. Mix out (destruction) of the fuel rich zones with the flue gas occurs due to the existing turbulence in the flow. Finally, REAB is less expensive than standard reburn because it uses less natural gas, does not require flue gas recirculation; and does not require completion air.

The key differences from standard reburn are injection of natural gas in a lower temperature zone, controlled or slow mixing of natural gas with flue gas, overall fuel-lean stoichiometry (local fuel rich zones exist in fuel eddies), lower natural gas usage, and no completion air.

The present invention is an improvement over the REAB technology.

SUMMARY OF THE INVENTION

In accordance with the present invention there is provided an improved apparatus and process for reducing the nitrogen oxides in furnace flue gas. A combustible fluid such as natural gas is introduced into the upper furnace through gas fired gas jet injectors. In these injectors a small portion of the natural gas is combusted with air (or vitiated air), the resultant gas is mixed with the majority of the natural gas, and the mixture is then injected into the furnace as a very fuel-rich jet. The combustion of a small fraction of natural gas is used to modulate the momentum of the gas jet and consequently its mixing characteristics. The combustion also increases the temperature of the resultant jet and accelerates the rate of the reburn chemistry. The injection of these jets into the furnace results in a complex mixing process which can be described by the formation and shedding of fuel rich eddies from the main jet. In these eddies the nitrogen oxide formed in the main burners will be reduced to ammonia, cyanide-like fragments, and $N_2$. As these eddies decay and mix with the flue gas, they experience an oxidizing environment, and additional NO reduction occurs because the ammonia like compounds react with more NO to form $N_2$. These 'thermal deNO$_x$' reactions occur in a narrow temperature range of 1700°–1900° F. Therefore, we locate and design the gas fired gas jets in such a manner so as to take advantage of the thermal deNO$_x$ chemistry. Thus, the nitrogen oxide in the flue gas is reduced in the fuel-rich eddies and during the mixing of these eddies with the oxidative flue gas. In standard reburn the HCN and $NH_i$ species reform NO because the completion process occurs at temperatures greater than 2200° F.

The above system is ideal for retrofitting existing furnaces. Because the process relies on controlled mixing to provide fuel-rich and fuel-lean environments, there is no need for an air addition stage. Because natural gas burns more rapidly at a lower temperature than other fuels, the fuel can be introduced at a higher elevation and at a lower temperature. This lower temperature acts to reduce the equilibrium level of nitrogen oxide in the flue gas and, hence, increases the nitrogen oxide reduction possible. The cost of reducing NO$_x$ is decreased because duct work is not necessary for injection of completion air or recirculated flue gas, and less natural gas is used. Therefore, both capital and operating costs are lower than in standard reburn. Other objects and advantages of the invention will become apparent as a description of the preferred embodiments proceeds.

DESCRIPTION OF THE PREFERRED EMBODIMENT

Figure 1:
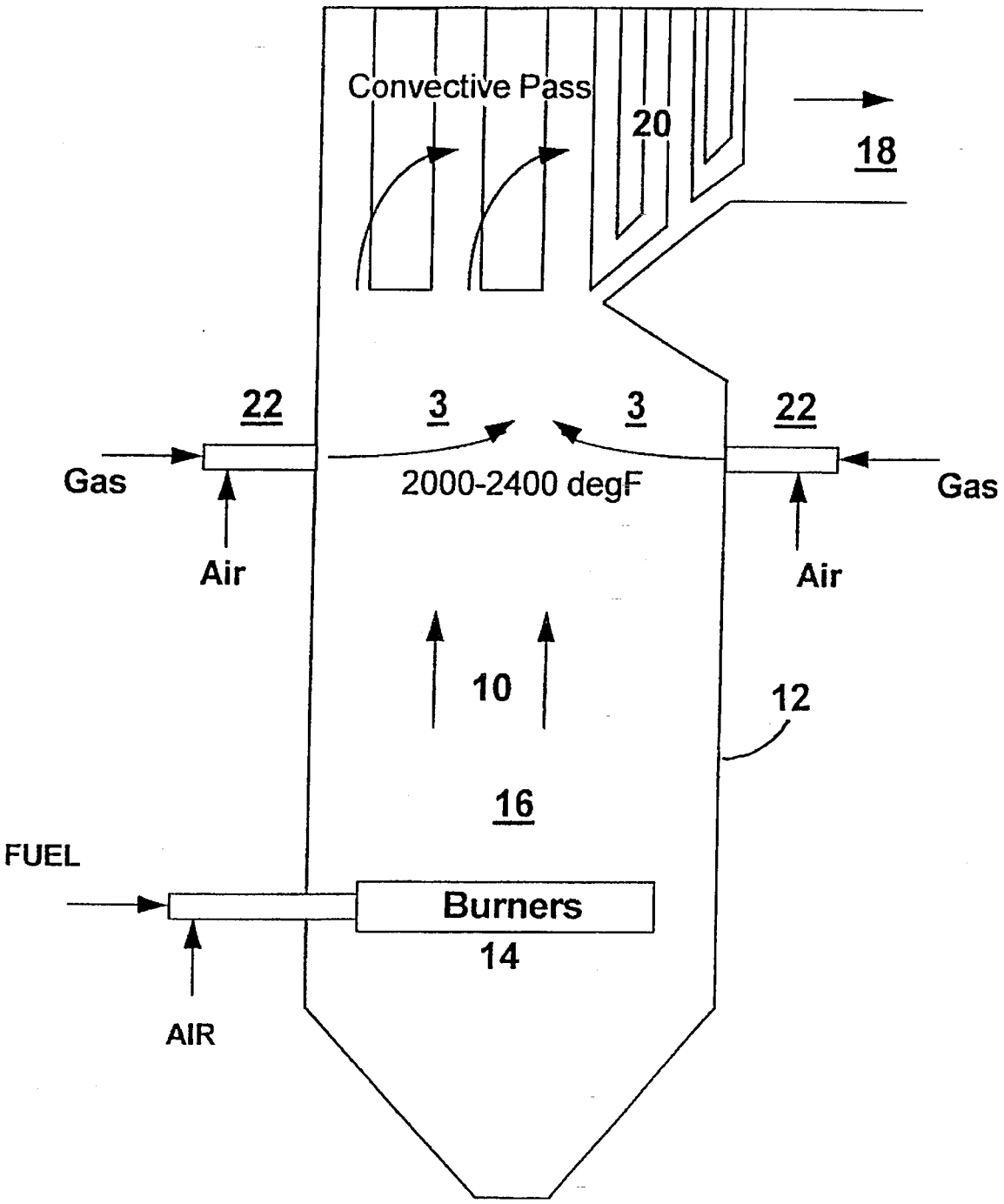
FIG. 1 is a schematic of an apparatus for reducing nitrogen oxide emissions in accordance with the principles of the present invention.

As shown in FIG. 1, our improved apparatus for reducing nitrogen oxide emissions in combustion products 10 can be readily retrofitted to a combustion device such as an existing furnace 12. The furnace 12 is designed to utilize coal or any other fuels such as oil or gas. The fuel enters the combustion device through burners 14 which are shown here in the lower portion of the combustion device 12. The fuel burns in the primary combustion zone 16 of the device within which temperatures are typically in excess of 3000° F. Combustion products 10 flow upward from the combustion zone 16, past convective heat exchangers 20, through duct work 18 and out of the furnace. Because of heat loss to furnace walls, the flue gas has a temperature of only 1800° to 2500° F. when it exits the furnace near the heat exchanger 20. Heat exchangers 20 in the upper portion of the furnace cause the temperature to drop very rapidly and any unburned fuel which enters these heat exchangers usually will be wasted and will exit the furnace as hydrocarbon emissions.

During the combustion of the fuel, some of the fuel bound nitrogen will react with oxygen to form NO$_x$ and some NO$_x$ will be formed from atmospheric nitrogen and oxygen. We are able to reduce NO$_x$ by injecting gas fired gas jets into the combustion device 12 between the combustion zone 16 and the heat exchanger 20. In FIG. 1, we provide gas fired gas injectors 22 to reduce the nitrogen oxide emissions in the combustion products. A combustible fuel such as natural gas enters the injectors through inputs 24 and 30 while air enters the injector through input 25 (See FIG. 2). The air flow is controlled to burn the desired amount of gas in the injector. The injector introduces high temperature, high momentum, fuel-rich, turbulent jets 3, indicated by arrows, into the furnace 12 above the primary combustion zone 16. The flue gas temperature at the location of jet introduction is in the range 2000°–2400° F. These jets contain mostly natural gas, nitrogen, products of combustion (water, carbon dioxide, and carbon monoxide), and highly reactive radicals such as the hydroxyl (OH), hydrogen (H), and oxygen (O) radicals. The jets mix and entrain the NO containing flue gas to create fuel-rich eddies where the NO is reduced to $N_2$, $NH_3$, and HCN.

The jet system is designed to achieve controlled mixing with the flue gas. For optimum NO$_x$ reduction the gas mixing time must be longer than the chemical kinetic time. This enables the destruction of NO to $N_2$, $NH_3$, and HCN to occur completely. Table I shows the chemical kinetic times for the reburn process for different temperatures and stoichiometries. The chemical time is a strong function of temperature and varies from 60 ms at 2800° F. to 200 ms at 2400° F. Therefore, the fuel-rich eddies created due to mixing of jets with flue gas must survive for times in the order of 60 to 200 ms. Due to heat release during combustion of natural gas the fuel eddy temperature could be 200°–400° F. higher than the background flue gas temperature. Thus, the NO$_x$ reduction occurs rapidly even at flue gas temperatures of 2000°–2400° F.

TABLE I

Chemical Kinetic Reburn Times

| Temperature, deg F. | Reburn Stoichiometry | Chemical Time, ms |
|---|---|---|
| 2200 | 0.90 | 450 |
| 2400 | 0.90 | 350 |
| 2600 | 0.85, 0.90, 1.00 | 280, 200, 100 |
| 2800 | 0.90 | 60 |
| 2000 | 1.0 | 600 |
| 2400 | 1.0 | 100 |
| 2600 | 1.0 | 25 |

The gas fired gas jet system is also designed to ensure that the fuel eddies burn out completely before leaving the furnace. Thus, the local fuel-rich zones created by the jets must mix out completely with the remaining flue gas in order to limit the carbon monoxide and unburned hydrocarbon emissions from the furnace. This mix out process is designed to occur in the temperature range 1800°–2000° F. where the $NH_3$ formed in the fuel-rich eddies further reacts with NO and reduces NO to $N_2$ due to the thermal deNO$_x$ reactions.

The desired controlled mixing is affected not only by the gas fired gas injector system design but also by the existing flue gas flow field. The flue gas flow field is dependent upon the furnace design and operation. Furnaces come in several different designs: tangential firing, wall firing, opposed firing, cyclone firing, and stoker firing. These furnaces result in quite different flow fields. For example, in tangential firing fuel is fired from four corners towards the center of the furnace and this results in setting up of a rotating flow field. In wall fired furnaces fuel is fired through swirl stabilized burners from one wall of the furnace. This results in primarily an upward gas motion with some down flow near the burners. Among operating variables, the furnace load affects the flow velocity, turbulence, and therefore, mixing. The flue gas excess oxygen will affect the stoichiometry-time history of the eddies created during mixing of the jets with the flue gas. In addition, the furnace flow field is non-uniform. The gas velocities and temperatures are lower near the walls and in the upper furnace. Therefore, implementation of the controlled mixing $NO_x$ reduction process is very site specific.

Figure 2:
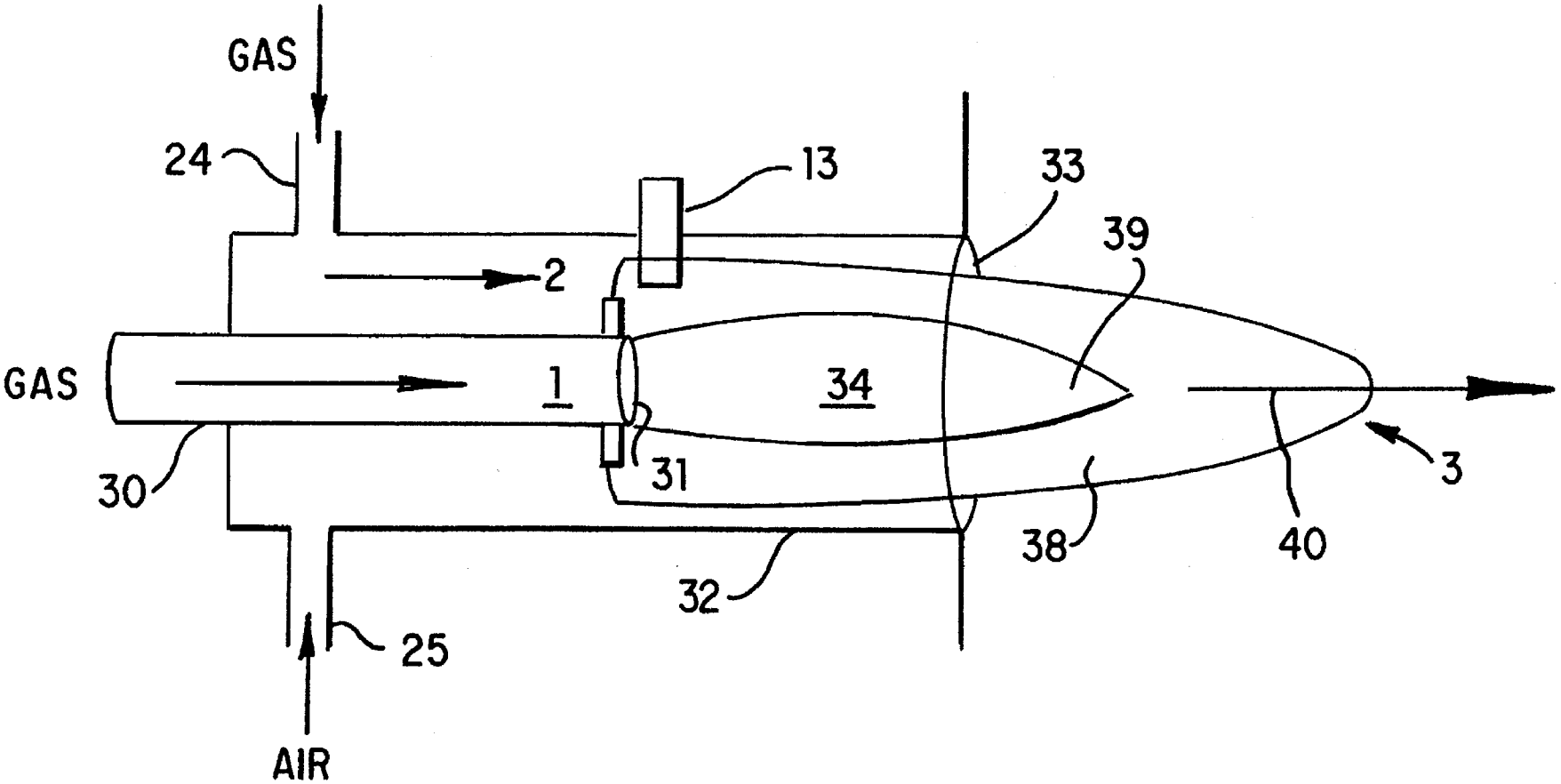
FIG. 2 is a schematic of the preferred configuration of the gas fired gas jet.

FIG. 2 shows a schematic of the preferred gas fired gas injector. The injector 22 consists of two pipes, an inner pipe 30 having a diameter $d_i$ through which a majority of the natural gas 1 is transported, and an outer pipe 32 having a diameter $d_o$ through which a combustible mixture of natural gas and air (or vitiated air) 2 is transported. The end 31 of the inner pipe 30 is within the outer pipe 32 at a selected distance x from the distal end 33 of outer pipe 32. This creates a flame stabilization and mixing zone 34 within outer pipe 32. For pipes in which $d_o$ is 6 inches and $d_i$ is 2 inches, a distance x of 6 to 12 inches is suitable. The stream 2 has a small amount of the total natural gas flow but its oxidizer flow ('air') could be comparable to or exceed the total natural gas flow. An igniter 13 is provided to ignite the gas within the flame stabilization and mixing zone 34. The outer flow 2 establishes a gas flame 38 at the distal end of the inner pipe 30 and within the outer pipe 32. The gas flame acts as a shroud around the inner pure gas jet 39 and prevents premature mixing of the natural gas with flue gas indicated by arrows 40. The gas flame also increases the momentum and temperature of the inner gas jet. This results in uniform mixing of the pure gas jet 1 with the combustion products of stream 2 without dilution from the flue gas. The net result is a more controllable fuel-rich jet.

Figure 3:
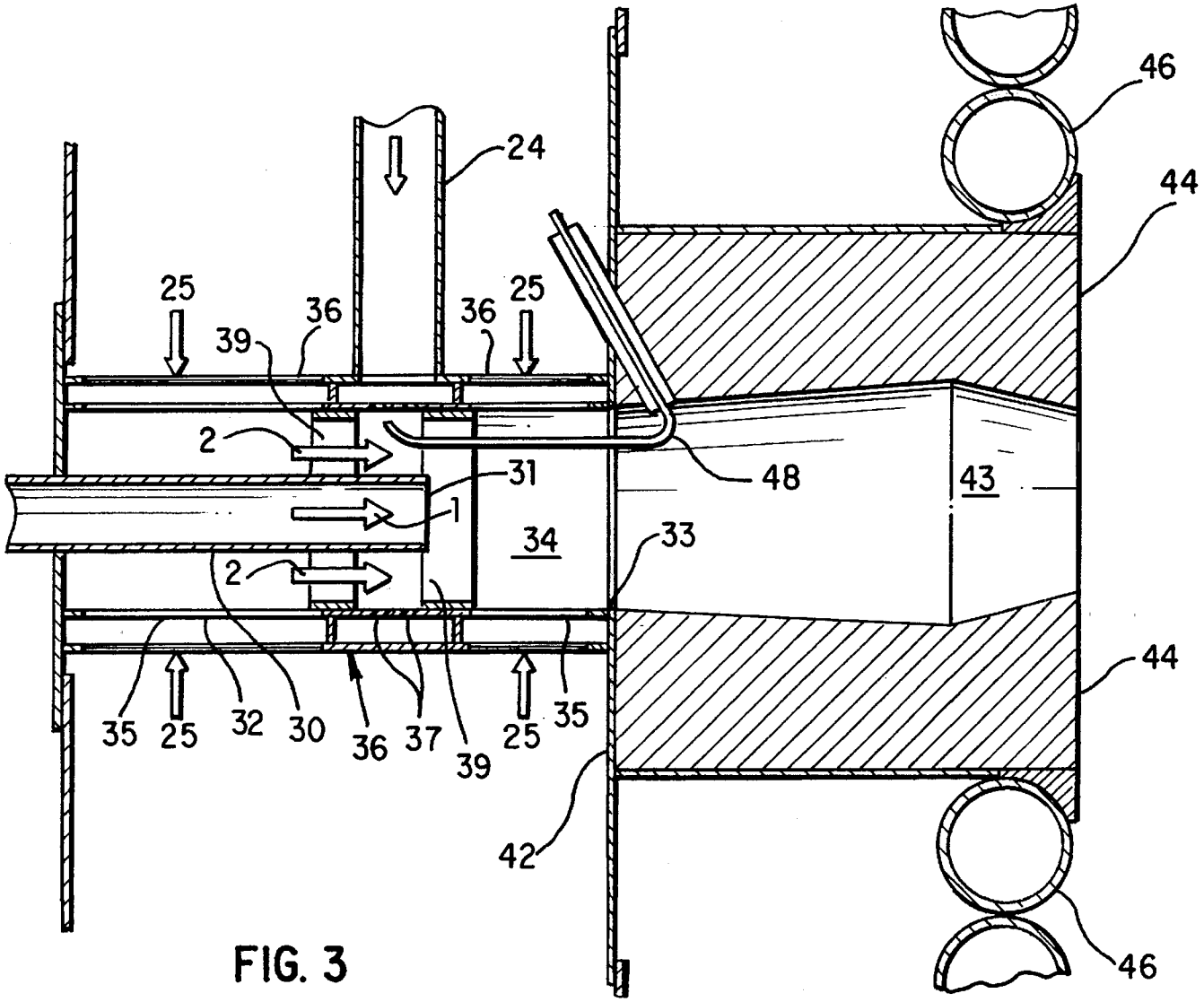
FIG. 3 is a cross-sectional view of the gas jet of FIG. 2 attached to a furnace wall.

In FIG. 3, the present preferred injector designed for a 327 MW cyclone fired boiler is shown attached to the furnace wall. The injector is comprised of an outer pipe 32, preferably 6 inches in diameter for this boiler application, and an inner pipe 30, which is preferably 2 to 2½ inches in diameter. The distal end 31 of the inner pipe is set back about 4 inches from the distal end 33 of the outer pipe to define flame stabilization and mixing zone 34. We also prefer to provide a slotted sleeve 36 which acts as both a gas manifold and as an air admittance manifold. This sleeve is formed from 8 inch pipe around the outer pipe 32. The distal end of the outer pipe 32 abuts the outer wall 42 of the furnace and communicates with a divergent convergent nozzle opening 43 in the burner tile 44 which lines the inside of the furnace. Boiler tubes 46 are adjacent the burner tile 44. We prefer to provide slots 35 in the sidewall of the outer pipe 32. We also prefer to provide air, or vitiated air, from an air supply plenum 25 connected via manifold pipe 36 through openings 35 in pipe 32. Gas supply pipe 24 is manifolded to openings 37 in and around the sidewall of outer pipe 32. This configuration preferably supplies a mixture of fuel and air as stream 2 flowing into the mixing zone 34. Less than 20% of the total fuel is supplied through pipe 32. Pipe 30 supplies the rest of the fuel (greater than 80%) with no air in it as stream 1. We also provide an igniter flame rod 48 which extends into the outer pipe 32. We also prefer to provide sliding arm dampers 39 adjacent to openings 35. The dampers 39 will enable us to adjust the flow of burner air through the openings 35 in the outer pipe 32.

The operation of the injector requires that at no time should a stoichiometric mixture of natural gas and air be flowing through the injector. Stoichiometric combustion within the injector will result in temperatures exceeding 3000° F. and melt the injector components and refractory tiles. Proper injector operation requires that the inner gas and outer gas/air flows be controlled in order to keep the peak gas temperature within the injector to less than 2400° F. Safe operation would be achieved by first starting the gas flow through pipe 30. The gas flow will be increased until carbon monoxide emission from the furnace 12 becomes unacceptable. At this point the air flow through pipe 32 will be started. The air flow will be increased until the air-to-fuel molar stoichiometry of the air flow through pipe 32 and gas flow through pipe 30 increases from 0.0 to approximately 0.50. A mixture with stoichiometry of 0.50 corresponds approximately to 20% natural gas in air by volume. The injector air will decrease the CO emission and permit an increased gas flow through pipe 30 until CO emission again becomes unacceptable. At this point the injector air flow could be increased further in order to decrease the CO emission. However, at no time will the stoichiometry of the air and gas be allowed to exceed 0.50. The stoichiometry less than 0.50 criteria eliminates the risk of explosion and high gas temperatures within the injector. Eventually the injector gas flow will attain the design value. The gas fired gas injector requires combustion of at most 20% of the total gas flow within the injector in order to modulate the furnace mixing process for $NO_x$ reduction. Therefore, the air-to-fuel stoichiometry at full load operation will never exceed 0.20. At approximately full load operation with 20% stoichiometric air flowing through pipe 32 and all the gas flowing through pipe 30, the gas flow through pipe 24 would be started and increased to establish a flammable gas/air mixture in the outer pipe 32. Since the resultant flame is cooled by the pure gas flow through pipe 30 the peak temperatures are kept below 2400° F. The above mentioned procedure will allow safe and reliable injector operation without the risks of overheating and/or explosions within the injector.

While the injector configuration described in FIG. 3 shows a pure gas inner jet flowing through pipe 30 and a flammable gas/air mixture flowing through the outer pipe 32, it is to be understood that the flammable gas/air mixture may be supplied through the inner pipe and the pure gas is then supplied through the outer pipe. This configuration results in an underventilated flame and the outer gas stream will be heated as it passes through the flame front. This configuration possesses many advantages over the previously described configuration in terms of flame stabilization and operation. The heat flux to the walls is lower than in the configuration described in FIG. 3 because the flame is kept in the center of the duct. The pure gas jet surrounds the flame jet and also cools the flame substantially.

The gas fired gas jet entering the furnace through our injector has a higher mass flow, temperature, velocity, and penetration compared to a simple natural gas jet. Calculations show that for 10% and 20% gas combustion such an injector has 2 to 4 times the mass flow of a simple gas jet. The injected gas temperature increases from 70° F. for 0% combustion to 900° F. for 10% combustion and 1100° F. for 20% combustion. Compared to a simple gas jet, the calculated penetration is 2.5 to 4.5 times for 10% and 20% combustion respectively.

The gas fired gas jet injector design allows field optimization of the mixing process for maximum $NO_x$ reduction and acceptable carbon monoxide and hydrocarbon emissions. Apart from overall system design features, such as number, size and location of injectors, and ability to tilt and yaw, the gas fired gas jet injector enables a change in the jet penetration and mixing by simply varying the fraction of gas combusted in the injector at fixed total natural gas flow. In a simple nozzle the jet penetration can only be increased by increasing the mass flow (and pressure drop) through the nozzle. The ability to control the penetration and stoichiometry of individual jets is extremely important for achieving high $NO_x$ reductions with minimum unburnt fuel emissions in furnaces with non-uniform NO, $O_2$, temperature and velocity distribution. Higher jet momentum and penetration, due to combustion of a larger fraction of the total gas input inside the injector, will result in deposition of more gas to the interior of the furnace, faster mixing, and more uniform conditions across the furnace cross-section.

This process reduces nitrogen oxide emissions by several methods. First, natural gas or other preferred hydrocarbon has no fixed nitrogen so no nitrogen oxides are produced from the source. In fact, the nitrogen oxide emission per Btu of fuel fired is decreased due to displacement of coal by natural gas. Secondly, the gas is injected at temperatures below 3000° F., and therefore, thermal nitrogen oxide formation is negligible. Thirdly, the natural gas reduces the NO in the flue gas. Nitric oxide reduction during reburning occurs via its reactions with $CH_i$ and $NH_i$ radicals. The partial oxidation and pyrolysis of the hydrocarbon fuel results in the formation of $CH_i$ radicals which react with NO to form HCN. Subsequently, HCN is reduced to $N_2$, $NH_3$, and NO. This is followed by reactions of NO with NH and $NH_2$ and further NO reduction. This sequence of reactions is favored under fuel rich conditions. Under well mixed fuel lean conditions competing oxidation reactions reduce reburn effectiveness.

While we have shown and described certain preferred embodiments of the invention it is to be distinctly understood that the invention is not limited thereto, but may be otherwise variously embodied within the scope of the following claims.

We claim:

1. An injector for injecting fuel into a furnace comprising:

a) an outer fuel transmission pipe having a diameter $d_o$ and a distal end from which a fluid exits the outer fuel transmission pipe and through which at least one of a combustible fuel and a mixture of a combustible fuel and air may be injected;

b) an inner fuel transmission pipe having a distal end and diameter $d_i$ where $d_i$ is less than $d_o$ and the inner fuel transmission pipe is positioned within the outer fuel transmission pipe and set back from the distal end of the outer fuel transmission pipe a sufficient distance to create a flame stabilization and mixing zone so that one of a combustible fuel and a mixture of a combustible fuel and air injected through the outer fuel transmission pipe will form a flame shroud around a stream of at least one of a combustible fuel and a mixture of a combustible fuel and air injected through the inner fuel transmission pipe;

c) an igniter within the outer fuel transmission pipe positioned to ignite the combustible fuel within the flame stabilization and mixing zone; and d) control means for varying, from 0% to 100%, the fraction of combustible fuel combusted in the injector by varying injector air flow attached to one of the inner fuel transmission pipe and the outer transmission pipe, said control means comprising a slide damper attached to said outer fuel transmission pipe.

2. The injector of claim 1 wherein $d_o$:$d_i$ is at least 2:1.

3. The injector of claim 1 wherein the injector is attached to a furnace and positioned to introduce the combustible fuel into flue gas, said flue gas being at a temperature of 2000° F. to 2400° F.

4. The injector of claim 1 wherein the diameter $d_i$ of the inner fuel transmission pipe and the diameter $d_o$ of the outer fuel transmission pipe are sized to provide a mixing time for the injected fuel and air mixture to completely mix with the flue gas in a manner so that said mixing time is longer than a chemical kinetic time for $NO_x$ reduction.

5. The injector of claim 3 wherein the injector is sized and positioned with respect to said furnace to effect mixout of fuel-rich eddies in a temperature zone of 1800°–2000° F. in said furnace.

6. The injector of claim 5 wherein the diameter $d_i$ of the inner fuel transmission pipe and the diameter $d_o$ of the outer fuel transmission pipe are sized and positioned with respect to said furnace to limit carbon monoxide and hydrocarbon emissions by effecting complete mixout of said fuel-rich eddies with an oxygen containing flue gas.

7. The injector of claim 1 wherein the injector is sized to supply up to 100% of stoichiometric air required to combust all the injected fuel.

8. A method for reducing $NO_x$ emissions in flue gas from a furnace having a combustion zone and a lower temperature zone above the combustion zone which lower temperature zone is at a temperature not greater than 2400° F. wherein the flue gas travels through the low temperature zone at a velocity $F_v$ comprising the steps of:

a) providing at least one injector at the lower temperature zone, which injector is comprised of an outer fuel transmission pipe, and a smaller diameter inner fuel transmission pipe within the outer fuel transmission pipe having a distal end set back within the outer fuel transmission pipe a sufficient distance to create a flame stabilization and mixing zone so that a mixture of a fuel and combustion air injected through the outer fuel transmission pipe will form a flame shroud around a fuel stream injected through the inner fuel transmission pipe, wherein the fuel is selected from the group comprised of natural gas, hydrogen, $C_xH_y$ compounds, $C_xH_yO_z$ compounds and mixtures thereof;

b) injecting fuel through the inner fuel transmission pipe into the lower temperature zone;

c) injecting a mixture of the fuel and combustion air through the outer fuel transmission pipe into the lower temperature zone in sufficient quantity to promote a reaction between nitrogen oxides in the flue gas and the fuel, so as to substantially reduce nitrogen oxides content of the flue gas; and d) igniting the fuel within the flame stabilization and mixing zone.

9. The method of claim 8 wherein the fuel is introduced into an upper section of the furnace.

10. The method of claim 8 wherein the furnace has a convective zone, and wherein the injector is positioned to introduce fuel into the convective zone.

11. The method of claim 8 wherein said flue gas temperature is within the range 2000°–2400° F.

12. The method in claim 8 wherein said flue gas is injected through the outer fuel transmission pipe.

13. The method of claim 8 wherein no additional air is injected above the injector.

14. The method of claim 8 wherein the fuel is injected at a velocity of $V_F$ and the fuel air mixture is injected at a velocity of $V_{FA}$ and the velocities of $V_F$ and $V_{FA}$ are selected so that the injected fuel and fuel air mixture will penetrate a desired distance into flue gas within the lower temperature zone.

15. The method of claim 8 wherein the fuel is injected at a velocity of $V_F$ and air is injected at $V_{FA}$ and the velocities $V_F$ and $V_{FA}$ are selected so the injected fuel and air mixture will mix with the flue gas in a manner so that a time required to complete mixing is greater than a reaction time of the injected fuel and fuel-air mixture with $NO_x$ in the flue gas.

16. The method of claim 8 wherein the stoichiometry of the air and fuel in the injector does not exceed 0.50.

17. A method for reducing $NO_x$ emissions in flue gas from a furnace having a combustion zone and a lower temperature zone above the combustion zone which lower temperature zone is at a temperature not greater than 2400° F. wherein the flue gas travels through the low temperature zone at a velocity $F_v$, comprising the steps of:

a) providing at least one injector at the lower temperature zone, which injector is comprised of an outer fuel transmission pipe and a smaller diameter inner fuel transmission pipe within the outer fuel transmission pipe having a distal end set back within the outer fuel transmission pipe a sufficient distance to create a flame stabilization and mixing zone so that a stream of a fuel injected through the outer fuel transmission pipe will form a flame shroud around a mixture of a fuel and combustion air injected through the inner fuel transmission pipe;

b) injecting a fuel through the outer fuel transmission pipe into a lower temperature zone;

c) injecting a mixture of the fuel and combustion air through the inner fuel transmission pipe into the lower temperature zone, the fuel being injected in sufficient quantity to promote a reaction between nitrogen oxide in the flue gas and the fuel, so as to substantially reduce nitrogen oxide content of the flue gas, no additional air being injected above said at least one injector; and d) igniting the fuel within the flame stabilization and mixing zone.

18. The method of claim 17 wherein the fuel is selected from the group comprised of natural gas, hydrogen, $C_xH_y$ compounds, $C_xH_yO_z$ compounds and mixtures primarily of those compounds.

19. The method of claim 17 wherein the fuel is introduced into an upper section of the furnace.

20. The method of claim 17 wherein the furnace has a convective zone, and wherein the injector is positioned to introduce fuel into the convective zone.

21. The method of claim 17 wherein said flue gas temperature is within the range of 2000°–2400° F.

22. The method in claim 17 wherein flue gas is injected through the outer fuel transmission pipe.

23. The method of claim 17 wherein the fuel is injected at a velocity of $V_F$ and the fuel air mixture is injected at a velocity of $V_{FA}$ and the velocities of $V_F$ and $V_{FA}$ are selected so that the injected fuel and fuel air mixture will penetrate a desired distance into flue gas within the lower temperature zone.

24. The method of claim 17 wherein the fuel is injected at a fuel velocity of $V_F$ and air is injected at an air velocity of $V_{FA}$, the velocities $V_F$ and $V_{FA}$ being selected so that the injected fuel and air mixture will mix with the flue gas in a manner so that a time required to complete mixing is greater than a reaction time of the injected fuel and fuel-air mixture with $NO_x$ in the flue gas.

25. The method of claim 17 wherein the stoichiometry of the air and fuel in the injector does not exceed 0.50.

* * * * *